US005803775A

United States Patent [19]

Henmi

[11] Patent Number: 5,803,775

[45] Date of Patent: Sep. 8, 1998

[54] STEERING ARRANGEMENT FOR JET PROPULSION UNIT

[75] Inventor: Yasuhiko Henmi, Hamamatsu, Japan

[73] Assignee: Yamaha Hatsudoki Kabushiki Kaisha, Shizuoka, Japan

[21] Appl. No.: 704,154

[22] Filed: Aug. 28, 1996

[51] Int. Cl.[6] ..... B63H 11/113

[52] U.S. Cl. ..... 440/42

[58] Field of Search ..... 440/38, 39, 40–43, 440/47; 60/221, 222

[56] References Cited

U.S. PATENT DOCUMENTS 3,143,857 8/1964 Eaton ..... 440/41

FOREIGN PATENT DOCUMENTS 1436462 5/1976 United Kingdom ..... 440/42

*Primary Examiner*—Jesus D. Sotelo

*Attorney, Agent, or Firm*—Knobbe, Martens, Olson & Bear, LLP

[57] ABSTRACT

A steering arrangement for a watercraft that includes a jet propulsion unit having a jet propulsion unit housing. The housing includes an inlet end and a discharge end with a propeller provided therebetween for drawing water from the inlet end and discharging the water in the form of a pressurized jet stream to the discharge end. The discharge end includes a fixed nozzle through which the jet stream of pressurized water flows. A pivoting nozzle is pivotally coupled to the discharge nozzle for guiding the jet stream of pressurized water for steering operation of the watercraft. A seal is effected between the discharge nozzle and steering nozzle upon steering action of the pivoting nozzle so as to prevent a generally forward flowpath of water between the fixed nozzle and pivoting nozzle.

18 Claims, 7 Drawing Sheets

STEERING ARRANGEMENT FOR JET PROPULSION UNIT

BACKGROUND OF THE INVENTION

This invention relates generally to a steering arrangement for a watercraft and more particularly to a steering arrangement for a watercraft having a jet propulsion unit.

Many watercraft, especially those of the personal type, include a jet propulsion unit as their marine propulsion system. A jet propulsion unit includes an impeller for drawing water from an inlet end of the unit and discharging the water under high pressure to a discharge end of the unit. A nozzle assembly is provided at the discharge end of the unit and includes a discharge nozzle for discharging a jet stream of the high pressure water so as to provide a propulsion force for the associated watercraft. A steering nozzle is pivotally connected to the discharge nozzle for controlling the direction of the propulsion force so as to propel and steer the watercraft.

One problem that has occurred with the nozzle assembly described above has been the escape of water out of the front of the steering nozzle. FIG. 1 illustrates the nozzle assembly described above. The nozzle assembly includes a steering nozzle B pivotally connected to a discharge nozzle A for rotation about a vertical axis. It should be noted that FIG. 1 could also illustrate a steering nozzle B pivotally connected to a discharge nozzle A for rotation about a horizontal axis for trim operation of the steering nozzle B. The flowpath of water through the assembly is shown when the steering nozzle B is aligned with the discharge nozzle A for straightforward steering or straight trim operation. Water flows straight through the nozzle assembly with a negligible amount of obstruction from the steering nozzle B.

FIG. 2 illustrates the flowpath of water through the nozzle assembly when the steering nozzle B is rotated to an angled position relative to the discharge nozzle A for steering or tilt operation of the steering nozzle B. The straight flowpath of water out of the discharge nozzle A is obstructed by an inner wall of the steering nozzle B. This obstructing of the flowpath out of the discharge nozzle A by the inner wall alters the direction of the flowpath so that most of it flows straight out of the steering nozzle B and produces a propulsion force that turns or tilts the watercraft. However, some of the flowpath out of the discharge nozzle A is obstructed by the inner wall of the steering nozzle B so that it flows in a generally forward direction through a clearance between the discharge nozzle A and steering nozzle B. This generally forward flowpath of water through the front of the steering nozzle B creates a propulsion force that counteracts the propulsion forces out of the rear of the steering nozzle B. Consequently, the associated watercraft does not produce the propulsion forces that it is capable of producing during steering and trim operation of the watercraft. As a result of the lost propulsion forces during steering, the watercraft does not turn as sharply or quickly as it potentially could. Another problem with this generally forward flowpath of water is that it may increase the exhaust back pressure in the engine if the exhaust system expels exhaust gases at a location where they may be interfered with by the generally forward flowpath of water. An increase in exhaust back pressure will decrease the power and fuel economy in the engine.

Some nozzle assemblies in the past have incorporated a gimbal ring into the assembly in order to allow trim and steering operation of the watercraft. The gimbal ring is pivotally mounted to the discharge nozzle for rotation about a horizontal axis. The steering nozzle is pivotally mounted to the gimbal ring for rotation relative to the gimbal ring about a vertical axis. The gimbal ring and steering nozzle rotate together relative to discharge nozzle about the horizontal axis for trim operation of the watercraft and the steering nozzle rotates relative to the gimbal ring for steering operation of the watercraft. When the steering nozzle undergoes simultaneous trim and steering operation, the problems with water escaping the front of the steering nozzle are compounded because both types of operation cause the generally forward flow of water between the discharge nozzle and the steering nozzle.

An attempt to prevent the generally forward flow of water through the front of the steering nozzle was made in the past, but was unsuccessful and did not address the problems caused by combined trim and steering operation of the watercraft.

It will be shown by the ensuing description of the present invention how the steering arrangement of the present invention eliminates the problems mentioned above.

SUMMARY OF THE INVENTION

A steering arrangement for a watercraft that includes a jet propulsion unit having a jet propulsion unit housing. The housing includes an inlet end and a discharge end with an impeller provided therebetween for drawing water from the inlet end and discharging water in the form of a pressurized jet stream to the discharge end. The discharge end includes a fixed nozzle through which the jet stream of pressurized water flows. A pivoting nozzle is pivotally coupled to the fixed nozzle for guiding the jet stream of pressurized water for steering operation of the watercraft. A seal is effected between the fixed nozzle and pivoting nozzle upon steering action so as to prevent the development of a generally forward flowpath of water between the fixed nozzle and pivoting nozzle caused by said steering operation of the watercraft.

BRIEF DESCRIPTION OF THE DRAWINGS

FIG. 3 is a side elevational view, with a portion of it broken away, of a watercraft that the present invention may be practiced with.

FIG. 4 is a partial view, with portions of it broken away and portions of it shown in phantom, of a rear portion of a watercraft that the present invention may be practiced with.

DETAILED DESCRIPTION OF THE PREFERRED EMBODIMENT OF THE INVENTION

Figure 3:
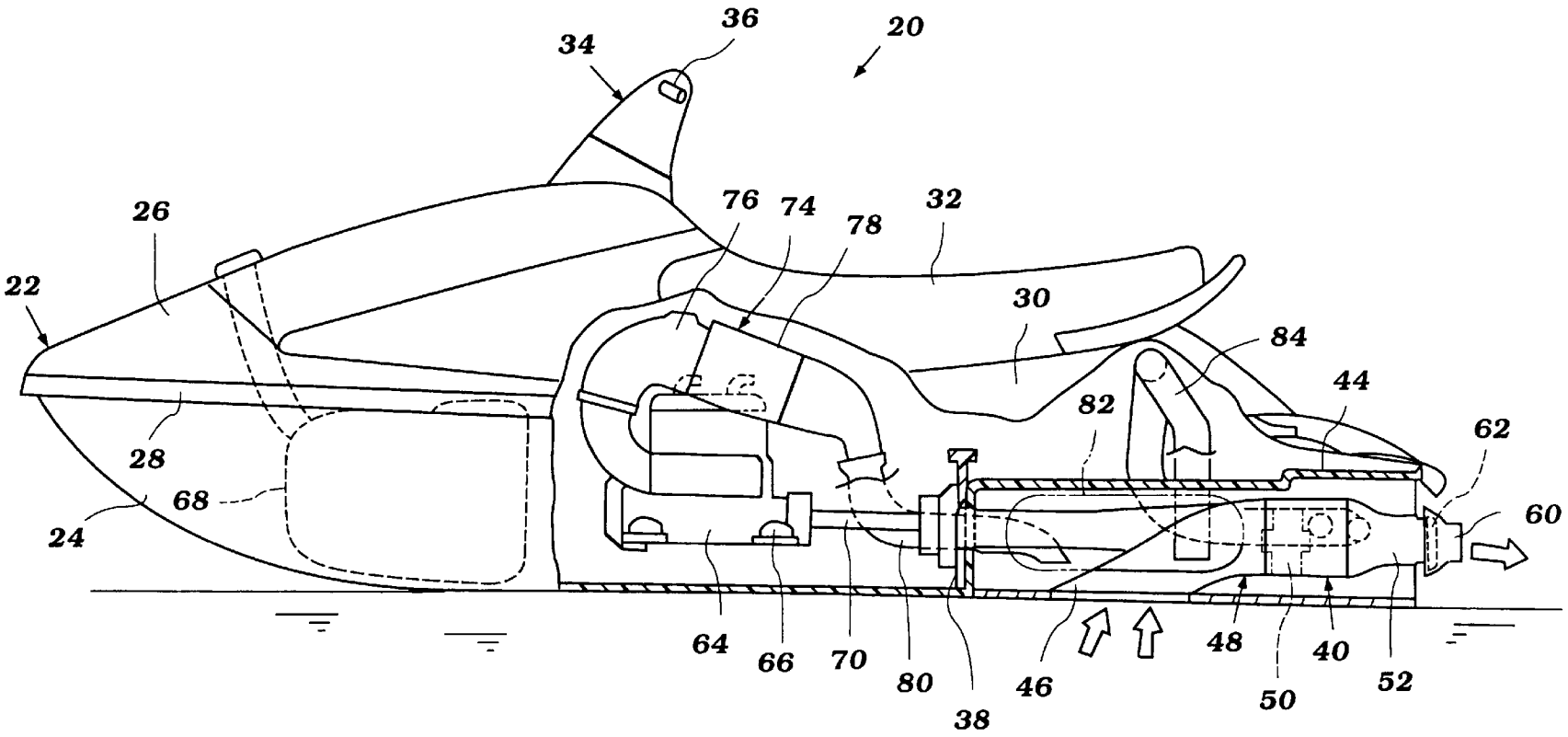
Figure 4:
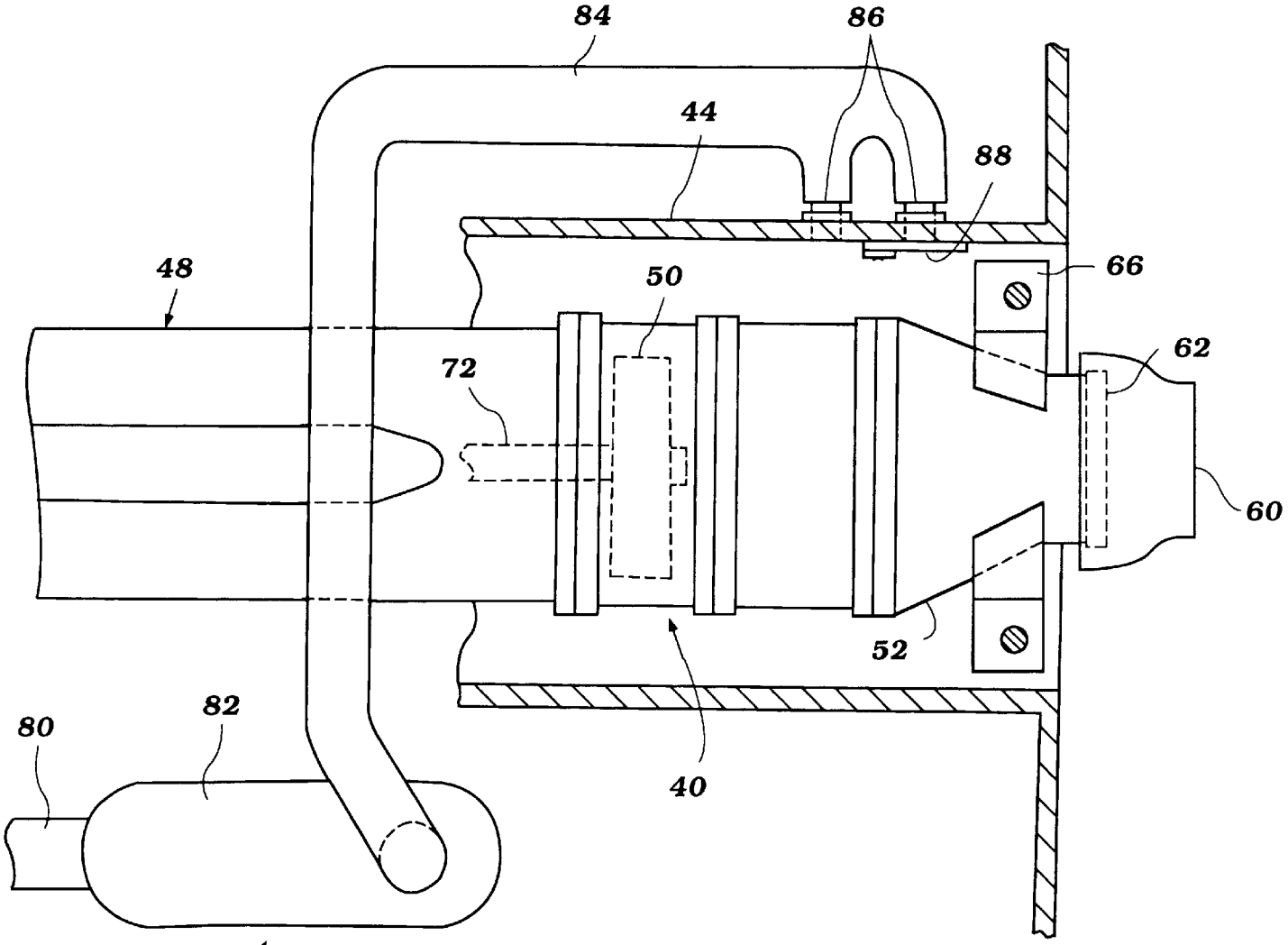
Figure 5:
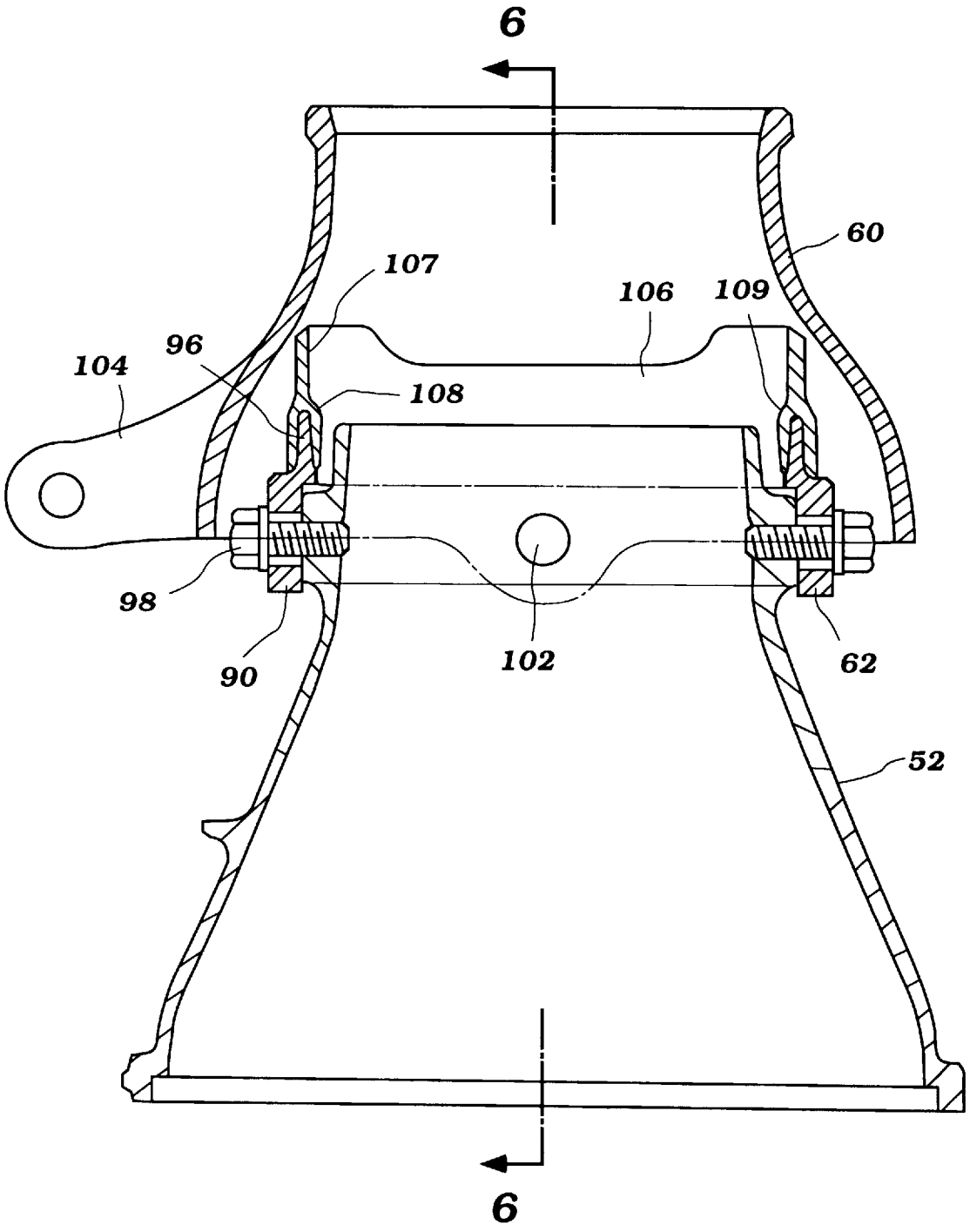
FIG. 5 is a top cross-sectional view of a structure that embodies the present invention and shows the steering nozzle in a straightforward steering position.

Referring now in detail to the drawings, and initially primarily to FIGS. 3–5, a small watercraft constructed in accordance with the present invention is identified generally by the reference numeral 20. The watercraft 20 is shown as being of the personal type. However, it will be readily understood by those skilled in the art that the present invention is not limited to personal watercrafts and can be practiced with a wide variety of watercrafts.

The watercraft 20 is comprised of a hull, indicated generally by the reference numeral 22, which is made up primarily of a lower hull portion 24 and an upper deck portion 26. The portions 24 and 26 are formed from a suitable material, such as molded fiberglass reinforced resin or the like, and are connected to each other in any manner known in this art. Normally, the connection is provided at an outstanding flange or gunnel 28 which extends around the peripheral edge of the hull 22.

The rearward portion of the hull 22 defines a rider's area. A raised pedestal 30 is provided in this rider's area upon which a seat cushion 32 is supported. Raised gunnels (not shown) are provided at the sides of the watercraft 20. Although not shown, foot areas are formed between the sides of the pedestal 30 and raised gunnels. Riders seated in straddle fashion on the seats 32 may place their feet in these foot areas. The foot areas open through the rear of the watercraft so as to facilitate boarding of the watercraft from the rear. The raised pedestal 30 is actually disposed forwardly of the rear end of the hull 22 so as to define a rear deck (not shown) upon which boarding may be made.

The area of the deck 26 in front of the seat 32 is provided with a control mast 34 that includes handlebars 36 for steering of the watercraft in a manner which will be described below. In addition, other watercraft controls, such as a throttle control, may be carried by the mast 34.

The portions 24 and 26 of the hull 22 define a compartment. This compartment serves, at least in part, as an engine compartment for housing an internal combustion engine to be described. The compartment extends partly beneath the seat 32 and terminates at its rear end in a bulkhead 38. A jet propulsion unit 40, which is driven by the engine in a manner described below, is mounted within a tunnel 44 formed in a recessed area in the underside of the hull portion 24, rearwardly of the bulkhead 38.

The jet propulsion unit 40 includes a jet pump housing 48. The jet pump housing 48 includes a water inlet opening 46 formed by the housing. The water inlet opening draws water from an opening formed in the underside of the hull portion 24. Water is drawn from the water inlet opening 46 and through the jet pump housing of the jet propulsion unit 40. An impeller 50, which is driven by the engine in a manner described in more detail below, draws the water through the jet pump housing 48 and, in turn, discharges a jet stream of water rearwardly past straightening vanes to a fixed discharge nozzle 52.

A steering nozzle 60 is pivotally coupled to the discharge nozzle 52 for pivotal movement of the steering nozzle 60 about a generally vertically extending steering axis. The steering nozzle 60 includes an inner wall 61 that obstructs and directs the jet stream of water for steering and trim operation of the watercraft. The steering nozzle 60 is coupled to the discharge nozzle 52 through a gimbal ring 62. Before discussing the nozzle assembly of the present invention in any more detail, the rest of the watercraft 20 will be described in order to assist the reader in gaining a greater understanding of the present invention.

Mounted within the engine compartment, forwardly of the bulkhead 38, and primarily beneath the forward portion of the seat 32, is the aforesaid internal combustion engine, indicated generally by the reference numeral 64. The engine 64 may be of any known type, but is preferably of the two-cylinder, in-line type operating on a two-stroke, crankcase compression principle. Those skilled in the art, however, will understand how the invention can be employed with engines having various cylinder numbers and orientations.

The engine 64 is mounted on engine mounts 66 in the hull portion 24 of the watercraft. The engine 64 includes an induction system (not shown) for delivering a charge to the engine 64. The induction system is not described in any more detail because it does not form part of the present invention. A fuel tank 68 is positioned in the engine compartment, forwardly of the engine 64, and supplies fuel to the engine 64 in a well-known manner in the art.

The engine 64 includes an output shaft 70, such as a crankshaft, that extends rearwardly through the end of the engine 64. A coupling (not shown) interconnects the output shaft 70 with an impeller shaft 72. The impeller shaft 72 extends rearwardly into the jet propulsion unit 40 and is coupled to the aforementioned impeller 50 in a known manner.

The exhaust products from the engine 64 are discharged to the atmosphere through an exhaust system, indicated generally by the reference numeral 74. This exhaust system 74 includes an exhaust manifold (not shown) that is affixed to one side of the engine 64 and receives the exhaust gases from the engine through exhaust ports in a well-known manner. The exhaust manifold terminates in a forwardly disposed discharge portion that communicates with a C-shaped pipe section, indicated generally by the reference numeral 76.

The C-shaped pipe section 76 is connected to a combined expansion chamber and catalytic converter device, indicated generally by the reference numeral 78. An outlet end of the expansion chamber and catalytic converter device 78 communicates with a flexible conduit 80. The flexible conduit 80 extends rearwardly along one side of the aforementioned tunnel 44 and is connected to the inlet section of a watertrap device 82.

An exhaust pipe 84 extends upwardly across the top of tunnel 44 and communicates the watertape device 82 to a pair of discharge ends 86 that open into the tunnel 44 at or below the water level. One of the discharge ends 86 includes a pressure-sensitive check valve 88 that opens and closes depending on exhaust pressure.

Figure 6:
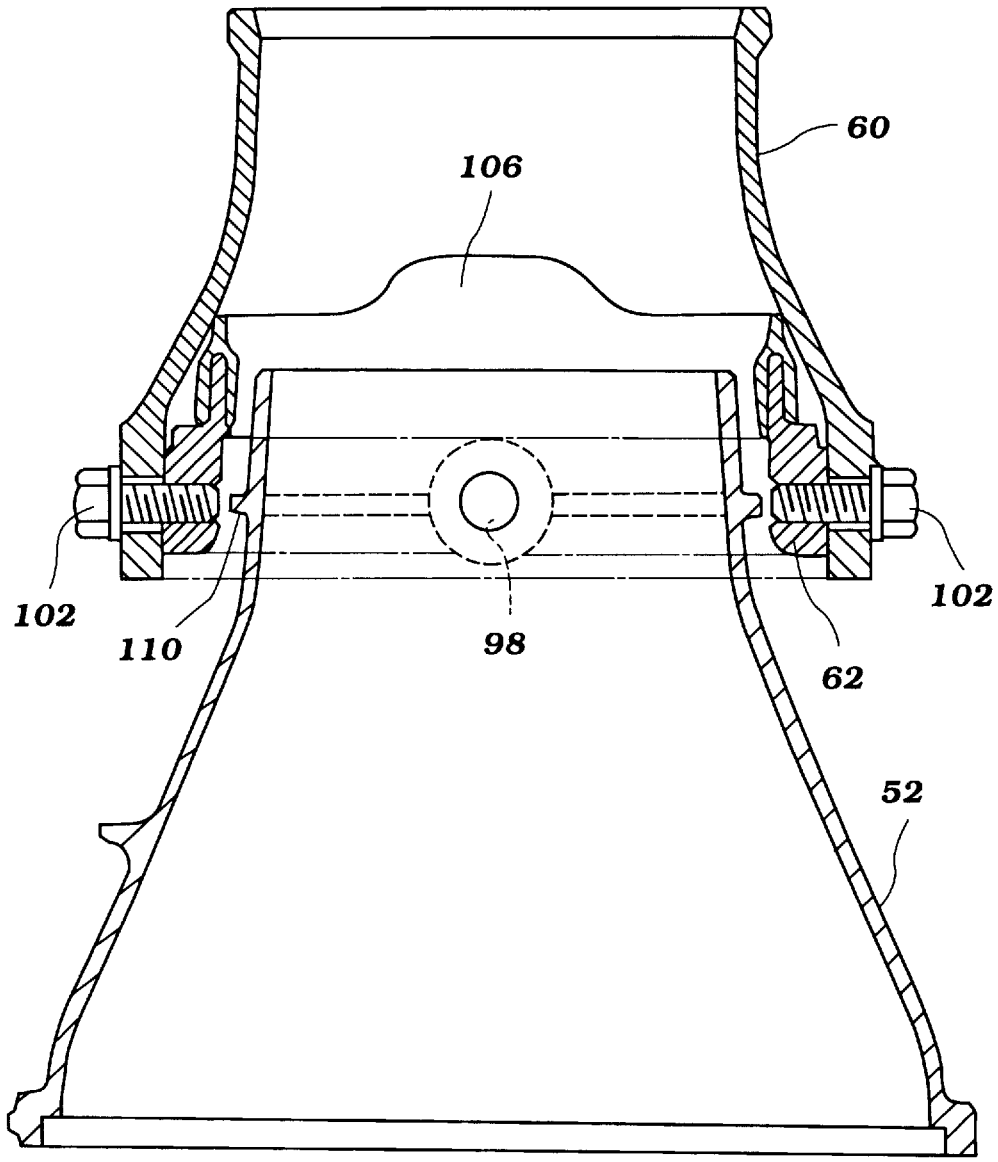
FIG. 6 is a cross-sectional view, taken along line 6—6 of FIG. 5, of a structure that embodies the present invention and shows the steering nozzle in an untrimmed position.

Referring generally to FIGS. 5 and 6, the nozzle assembly of the present invention will now be described in more detail. As mentioned previously, the steering nozzle 60 is coupled to the discharge nozzle 52 through a gimbal ring 62. The gimbal ring 62 includes a generally cylindrical base portion 90. A generally cylindrical flange 96 extends from the cylindrical base portion 90 and is inwardly disposed relative to the base portion 90. Threaded fasteners 98 are provided at opposite sides of the gimbal ring 62 for pivotally connecting the gimbal ring 62 to the discharge nozzle 52 for rotation about a generally horizontally extending imaginary axis. The gimbal ring is coupled to the mast 34 in any manner known in the art for trim movement of the gimbal ring 62 and steering nozzle 60.

Threaded fasteners 102 are provided at opposite ends of the steering nozzle 60 for pivotally connecting the steering nozzle 60 to the gimbal ring 62 for rotation about a generally vertically extending imaginary axis. The steering nozzle 60 includes a steering lever 104 that is coupled by means of a Bowden wire cable, or the like, to the mast 34 for pivotal steering movement of the steering nozzle 60 relative to the gimbal ring 62. Thus, the steering nozzle 60 rotates with the gimbal ring for trim operation of the steering nozzle 60 about the generally horizontally extending axis and rotates relative to the gimbal ring 62 for steering operation of the steering nozzle 60 about the generally vertically extending axis.

An elastic seal 106 is provided on the gimbal ring 62 between the discharge nozzle 52 and steering nozzle 60 and rotates with the gimbal ring 62. The flexible nature of the seal 106 provides a tight fit with the inner wall 61 of the steering nozzle 60 so as to preclude the development of the generally forward flow of water between the discharge nozzle 52 and steering nozzle 60 caused by the obstructing of the inner wall 61 of the steering nozzle 60 with the jet stream of water out of the discharge nozzle 52 that occurs during steering operation of the watercraft.

The seal 106 has a generally Y-shaped cross-section and is formed by a generally cylindrical elongated projection 107 that diverges into a generally cylindrical base portion 108. An annular groove 109 is formed by the diverging base portion 108. This groove 109 allows the seal 106 to easily slide onto the flange 96 of the gimbal ring 62. The elongated and flexible nature of the elastic seal 106, as will be shown below, helps to prevent the forward flow of water through the two nozzles 52 and 60.

The elongated projection 107 of the seal 106 has a length that is designed to abut the inner wall 61 of the steering nozzle 60 so as to preclude the development of the forwardly directed water flowpath when the steering nozzle 60 is rotated to a point that would cause the generally forward flowpath of water mentioned above. This eliminates the need to employ a seal of undue length that abuts, and possibly interferes with, the inner wall of the steering nozzle at all steering position.

Referring to FIGS. 5–8, the present invention will now be described in use. During steering operation of the watercraft, the steering nozzle 60 is rotated relative to the gimbal ring 62 about the generally vertically extending axis. If a throttle is engaged during steering operation, a jet stream of pressurized water will be forced straight out of the jet propulsion unit 40 and into the steering nozzle 60. If the steering nozzle 60 is positioned for straightforward steering (see FIG. 5), the flowpath of the pressurized water from the jet propulsion unit will flow straight out of the rear of the steering nozzle 52, relatively unobstructed by the inner wall 61 of the steering nozzle 52. This unobstructed flowpath causes straight rearward propulsion forces that cause the watercraft to travel in a straight manner.

Figure 1:
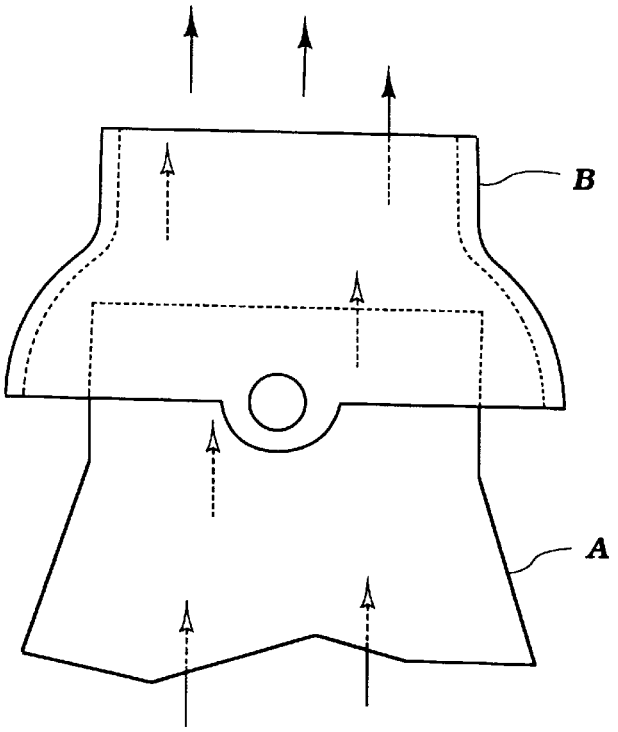
Figure 1 Prior Art
FIG. 1 is a top view of a prior art nozzle assembly and shows the flow of water through the assembly when the steering nozzle is in a straightforward steering position or a side view of a nozzle assembly and shows the flow of water through the assembly when the steering nozzle is in an untrimmed position.
Figure 2:
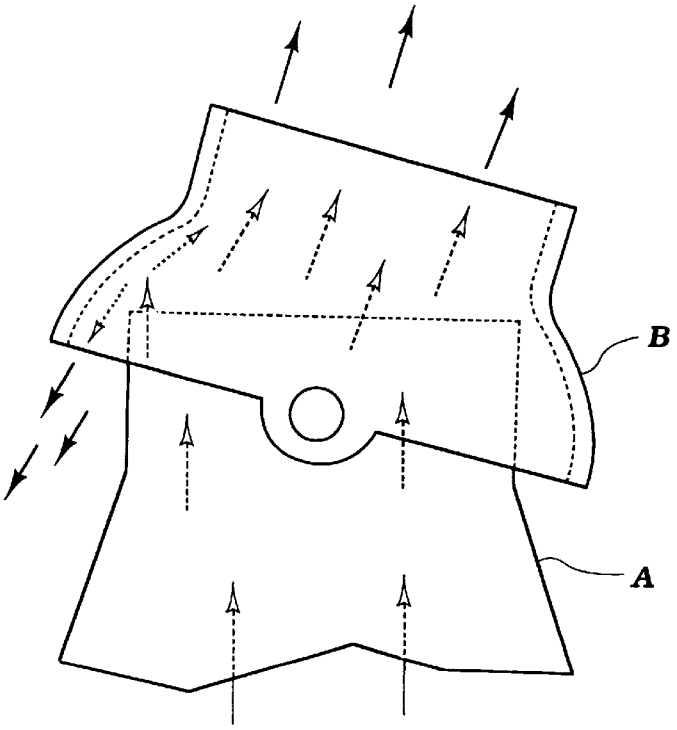
Figure 2 Prior Art
FIG. 2 is a similar view to FIG. 1 and shows the flow of water through the assembly when the steering nozzle is in an angled steering position or tilted-down trim position.
Figure 7:
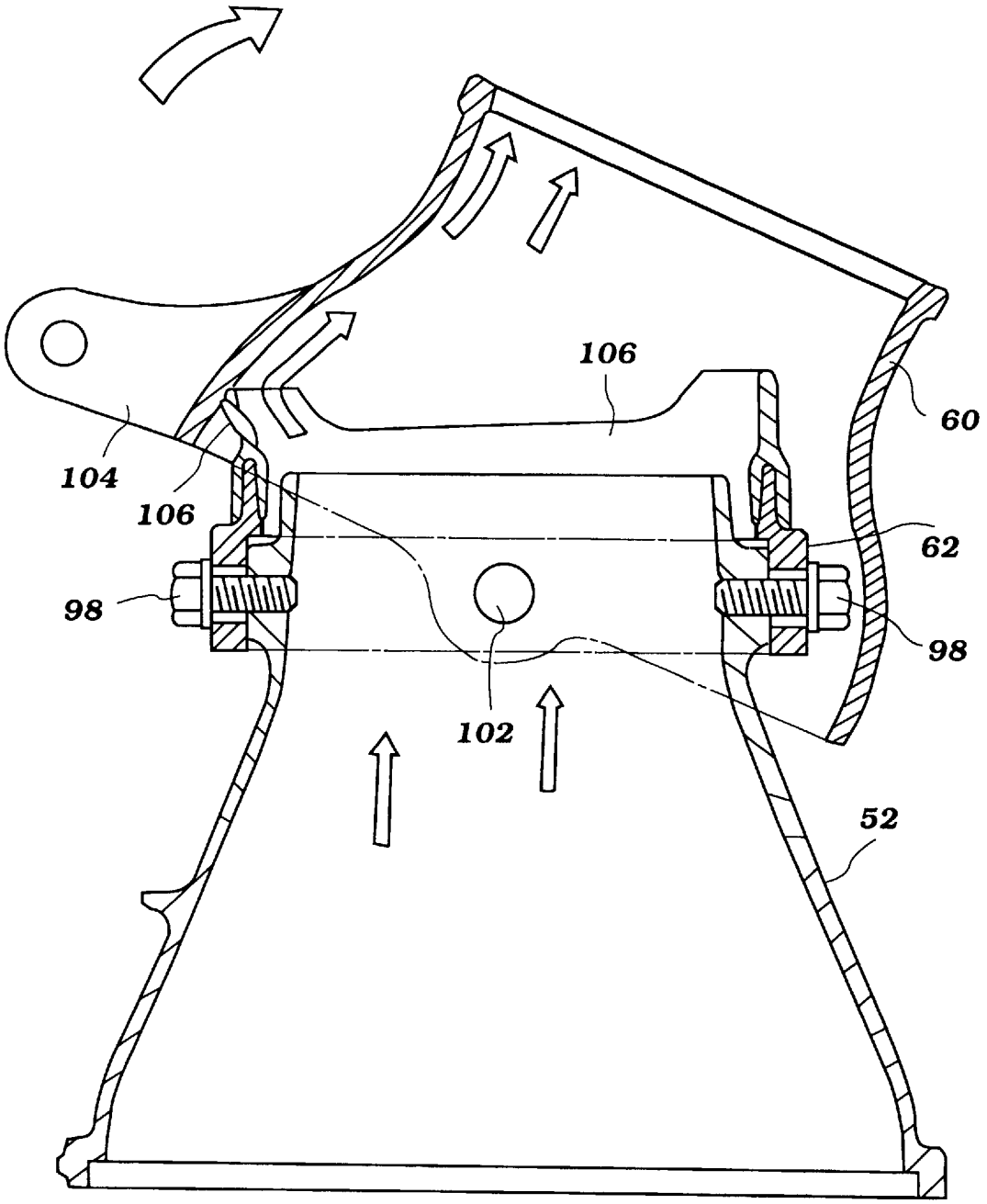
FIG. 7 is a similar view to FIG. 5 and shows the steering nozzle rotated to an angled steering position and a tilted-down trim position.

When the steering nozzle 60 is rotated to an angled steering position relative to the discharge nozzle 52, as shown in FIG. 7, the flowpath of pressurized water of the discharge nozzle will be obstructed by the seal 106 and inner wall 61 of the steering nozzle 60. This obstruction of the flowpath alters the direction of the water flow and corresponding propulsion forces out of the watercraft, and causes the steering of the watercraft. Without the seal 106, some of the water discharged from the discharge nozzle 52 would be obstructed by the inner wall of the steering nozzle 60 so as to cause a generally forward flow of water through the space between the discharge nozzle 52 and steering nozzle 60 (See FIG. 2). The seal 106 precludes this generally forward flowpath of water through the space between the discharge nozzle 56 and steering nozzle 60 during steering operation. As a result, the seal 106 allows the watercraft to make sharper and quicker turns than without it because water propulsion forces are not lost out of the front of the steering nozzle 60 during steering operation.

Referring to FIG. 4, some watercrafts include an engine exhaust system that is designed to expel exhaust gases into the tunnel 44. If the discharge location for the exhaust gases is adjacent to this generally forward flowpath of water, this generally forwardly directed water may interfere with the flow of exhaust gases out of the exhaust system 74 and increase the back pressure in the exhaust system 74, decreasing power and fuel economy in the engine. In watercrafts that include a pressure-sensitive check valve 88, exhaust back pressure problems may be more prevalent because the generally forward flow of water may prevent the valve 88 from opening. By precluding this generally forward flowpath of water, seal 106 prevents this problem.

Figure 8:
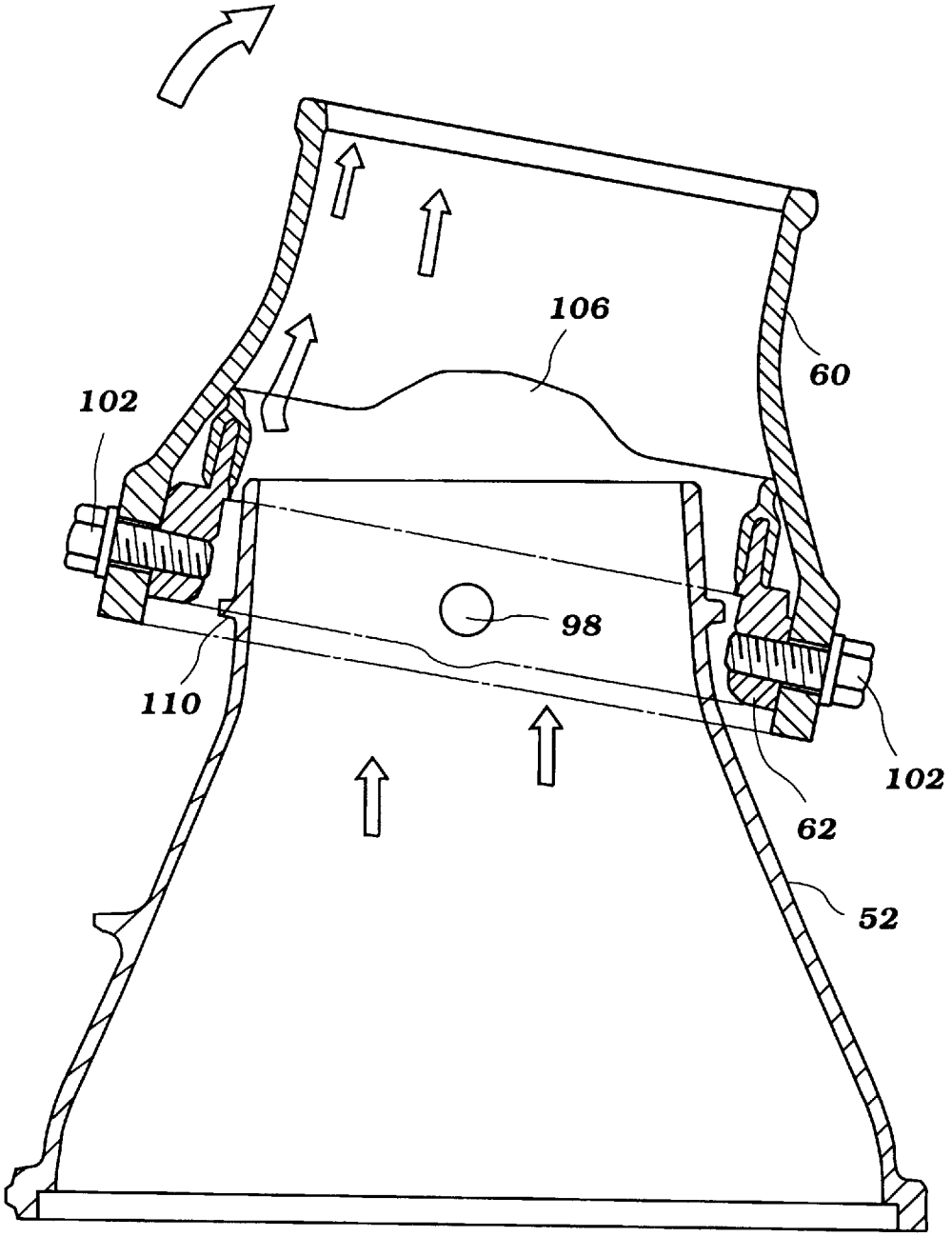
FIG. 8 is a similar view to FIG. 6 and shows the steering nozzle in an angled steering position and a tilted-down trim position.

Referring to FIGS. 6 and 8, when an operator manipulates the trim of the watercraft, the steering nozzle 60, gimbal ring 62 and seal 106 rotate together about the generally horizontally extending axis. The inwardly disposed flange 96 and seal 106 that extends therefrom are provided in close proximity to the discharge nozzle 52 and are generally aligned with the jet stream of water out of the discharge nozzle 50. This prevents the generally forward flowpath of water caused by the inner wall 61 of the steering nozzle 60 obstructing the flowpath of water out of the discharge nozzle 52 during trim operation. An annular collar 110 extends peripherally around the outer surface of the discharge nozzle 52 so as to provide even greater protection for preventing the generally forward water flowpath from forming.

Referring to FIGS. 7 and 8, when an operator simultaneously manipulates the steering and trim of the watercraft, the problem with the generally forward flow of water is compounded. Adjusting the steering of the watercraft will cause a generally forward flowpath of water between the steering nozzle 60 and the discharge nozzle 52 in a manner described above. Adjusting the trim of the watercraft will cause an additional flowpath of water to form between the steering nozzle 60 and discharge nozzle 52. As a result, more water will escape out of the front of the steering nozzle when the steering nozzle 60 is configured for combined trim and steering operation. The seal 106 prevents the generally forward flow of water caused by combined steering and trim operation. The projection 107 of the seal abuts the inner wall 61 of the rotated steering nozzle 60 so as to prevent the generally forward flow of water between the steering nozzle 60 and discharge nozzle 52 upon steering operation of the steering nozzle 60. The base 108 of the seal 106 nearly abuts the discharge nozzle 52 and the seal 106 extends in the same direction as the flowpath of water out of the discharge nozzle 52 so as to prevent the forward flow of water between the discharge nozzle 52 and steering nozzle 60 upon trim operation of the steering nozzle 60.

From the foregoing description, it should be readily apparent how the present invention eliminates the generally forward flow of water through the space between the discharge nozzle and steering nozzle during steering operation, tilt operation and combined steering and tilt operation of the watercraft. Of course, the foregoing description is that of a preferred embodiment of the invention, and various changes and modifications may be made without departing from the spirit and scope of the invention, as defined by the appended claims.

What is claimed is:

1. A jet propulsion unit for a watercraft comprising a housing, said housing including an inlet end and a discharge end, an impeller provided within said housing for drawing water from said inlet end and discharging the water in the form of a pressurized jet stream to the discharge end of said housing, said discharge end including a fixed nozzle having a discharge opening through which said jet stream of pressurized water flows rearward, a pivoting nozzle pivotally coupled to said fixed nozzle for guiding the jet stream of pressurized water for steering operation of the watercraft, and means for inhibiting a generally forward flow of water between the fixed nozzle and the pivoting nozzle upon pivoting action of said pivoting nozzle, said means circumscribing said discharge end of said fixed nozzle.

2. A jet propulsion unit as in claim 1, wherein said pivoting nozzle pivots about a generally horizontal axis.

3. A jet propulsion unit as in claim 1, wherein said pivoting nozzle pivots about a generally vertical axis.

4. A steering arrangement for a watercraft comprising a jet propulsion unit said jet propulsion unit, including a housing, said housing including an inlet end and a discharge end, an impeller provided within said housing for drawing water from said inlet end and discharging the water in the form of a pressurized jet stream to the discharge end of said housing, said discharge end including a fixed nozzle through which said jet stream of pressurized water flows rearward, a pivoting nozzle pivotally coupled to said fixed nozzle for guiding the jet stream of pressurized water for steering operation of the watercraft, and a seal effected between said fixed nozzle and said pivoting nozzle upon pivoting of said pivoting nozzle to inhibit a generally forward flow of water between the fixed nozzle and pivoting nozzle upon at least when the pivoting nozzle is pivoted, said seal being made of a flexible elastic material.

5. The steering arrangement of claim 4, wherein said pivoting nozzle rotates relative to said seal about a generally vertically extending axis and rotates with said seal about a generally horizontally extending axis.

6. The steering arrangement of claim 4, wherein said seal has a generally cylindrical base, a generally cylindrical projection extends from said base.

7. The steering arrangement of claim 6, wherein said generally cylindrical projection contacts an inner wall of said pivoting nozzle when said pivoting nozzle is rotated to a point so as to cause said generally forward flowpath of water.

8. steering arrangement of claim 4, wherein a pivoting ring is pivotally mounted to said fixed nozzle for rotation relative to said fixed nozzle about a generally horizontally extending axis, said pivoting nozzle is pivotally mounted to said pivoting ring for rotation with said pivoting ring about said generally horizontally extending axis and rotation relative to said pivoting ring about a generally vertically extending axis.

9. The steering arrangement of claim 8, wherein said seal is made of a flexible elastic material.

10. The steering arrangement of claim 9, wherein said pivoting nozzle rotates relative to said seal about the generally vertically extending axis and rotates with said seal about the generally horizontally extending axis.

11. The steering arrangement of claim 10, wherein said seal has a generally cylindrical base, a generally cylindrical projection extends from said base.

12. The steering arrangement of claim 11, wherein said generally cylindrical projection contacts an inner wall of said pivoting nozzle when said pivoting nozzle is rotated to a point so as to cause said generally forward flowpath of water.

13. The steering arrangement of claim 11, wherein the generally cylindrical base of said seal is provided in close proximity to said discharge nozzle and said seal extends in substantially the same direction as the jet stream of water out of the discharge nozzle upon trim action so as to preclude said generally forward flowpath of water.

14. A steering arrangement for a watercraft comprising a jet propulsion unit, said jet propulsion unit including a housing, said housing including an inlet end and a discharge end, an impeller provided within said housing for drawing water from said inlet end and discharging the water in the form of a pressurized jet stream to the discharge end of said housing, said discharge end including a fixed nozzle through which said jet stream of pressurized water flows, a pivoting ring pivotally connected to said fixed nozzle for rotation relative to said fixed nozzle about a generally horizontal axis, a pivoting nozzle pivotally coupled to said pivoting ring for rotation with said pivoting ring about said generally horizontally extending axis for guiding the jet stream of pressurized water for trim operation of the watercraft and rotation relative to said pivoting ring about a generally vertically extending axis for guiding the jet stream of pressurized water for steering operation of the watercraft, and means for precluding a generally forward flowpath of water between the fixed nozzle and pivoting nozzle upon steering and trim action of said pivoting nozzle carried by said pivoting ring.

15. The steering arrangement of claim 14, wherein said water flowpath precluding means includes a seal carried by said pivoting ring that is effected between said fixed nozzle and pivoting nozzle upon steering and trim action of said pivoting nozzle.

16. The steering arrangement of claim 15, wherein said seal has a generally cylindrical base, a generally cylindrical projection extends from said base.

17. The steering arrangement of claim 16, wherein said generally cylindrical projection contacts an inner wall of said pivoting nozzle when said pivoting nozzle is rotated to a point so as to cause said generally forward flowpath of water.

18. The steering arrangement of claim 16, wherein said generally cylindrical base of said seal is provided in close proximity to said discharge nozzle and said seal extends in substantially the same direction as the jet stream of water out of the discharge nozzle upon trim action so as to preclude said generally forward flowpath of water.

* * * * *